US005931459A

United States Patent [19]

Landgren

[11] Patent Number: 5,931,459

[45] Date of Patent: Aug. 3, 1999

[54] CONVEYOR DEVICE

[75] Inventor: Johan Landgren, Eksjö , Sweden

[73] Assignee: Sten Wallsten Industries AB, Eksjö , Sweden

[21] Appl. No.: 08/776,986

[22] PCT Filed: Aug. 18, 1995

[86] PCT No.: PCT/SE95/00951

§ 371 Date: Mar. 12, 1997

§ 102(e) Date: Mar. 12, 1997

[87] PCT Pub. No.: WO96/06032

PCT Pub. Date: Feb. 29, 1996

[30] Foreign Application Priority Data

Aug. 19, 1994 [SE] Sweden ..... 9402771

[51] Int. Cl.[6] ..... B65H 29/04

[52] U.S. Cl. ..... 271/204; 271/205

[58] Field of Search ..... 271/205, 204

[56] References Cited

U.S. PATENT DOCUMENTS

| | | | |
|---|---|---|---|
| 1,079,218 | 11/1913 | Curtis | 271/204 |
| 1,540,687 | 6/1925 | Feistel et al. | 271/204 |
| 4,205,837 | 6/1980 | Von Hein et al. | 271/204 |
| 4,799,664 | 1/1989 | Burger | 271/204 |
| 5,320,341 | 6/1994 | Pease et al. | 271/277 |

FOREIGN PATENT DOCUMENTS

| | | | |
|---|---|---|---|
| 4302127 | 7/1994 | Germany | 271/204 |
| 63-332397 | 12/1988 | Japan . | |
| 682819 | 11/1993 | Switzerland | 271/204 |

*Primary Examiner*—Karen M. Young
*Assistant Examiner*—Steven B. McAllister
*Attorney, Agent, or Firm*—Cohen, Pontani, Lieberman & Pavane

[57] ABSTRACT

The device according to the present invention is primarily intended to be used for handling and conveyance of newspapers and magazines. The clamping devices of the conveyor (4) are designed as clamps, where the clamp is closed by spring loading and can be opened by actuating one of the two parts of the clamp. The arm is actuated by cams (7, 7A) which are mounted at the periphery of a wheel (8) which rotates synchronously with the conveyor. The cams are movable and a control system decides if each cam shall be in a position where it actuates or does not actuate the corresponding clamp. In a preferred embodiment of the invention the clamp and the device are symmetric having a plane of symmetry in the middle of the conveyor and in its direction of movement.

8 Claims, 4 Drawing Sheets

23
24
25
20
16
19
17
8
26
7A
13
15
6
29
7
6
50
14
42
28
27
11
9
16
12
22
21
25
25
23

CONVEYOR DEVICE

BACKGROUND OF THE INVENTION

The present invention is for a device for delivery of selected items from a conveyer. The items are then fixed to the conveyor by means of a separate holding device for each item.

The device according to the present invention is primarily intended to be used for handling and conveyance of newspapers and magazines. The gripping devices of the conveyor are designed as clamps, where the clamp is closed by spring loading and can be opened by actuating one of the two parts of the clamp.

The production of magazines and newspapers takes place using printers and other equipment with great capacity and may be 10–20 copies per second. These shall be distributed both as stacks for further distribution and as single copies for checking and other purposes. Therefore, the finished copies are picked up by a conveyor having several delivery stations. The papers are then held by clamps on the conveyor. These clamps are positioned at a defined and equal distance from each other. The device according the the invention is connected to these delivery stations.

SUMMARY OF THE INVENTION

The device according to the invention comprises that the clamps are opened by actuating an arm which is part of one shank of each clamp. The arm is actuated by cams which are mounted at the periphery of a wheel which rotates synchronously with the conveyor. The cams are movable and there is a control system which determines whether each cam shall be in a position where it actuates or does not actuate the corresponding clamp. In a preferred embodiment of the invention the clamp and the device are symmetric having a plane of symmetry in the middle of the conveyor in its direction of movement.

BRIEF DESCRIPTION OF THE DRAWINGS

The invention will be described with reference to the embodiment shown in the following figures.

DETAILED DESCRIPTION OF THE PREFERRED EMBODIMENT

Figure 1:
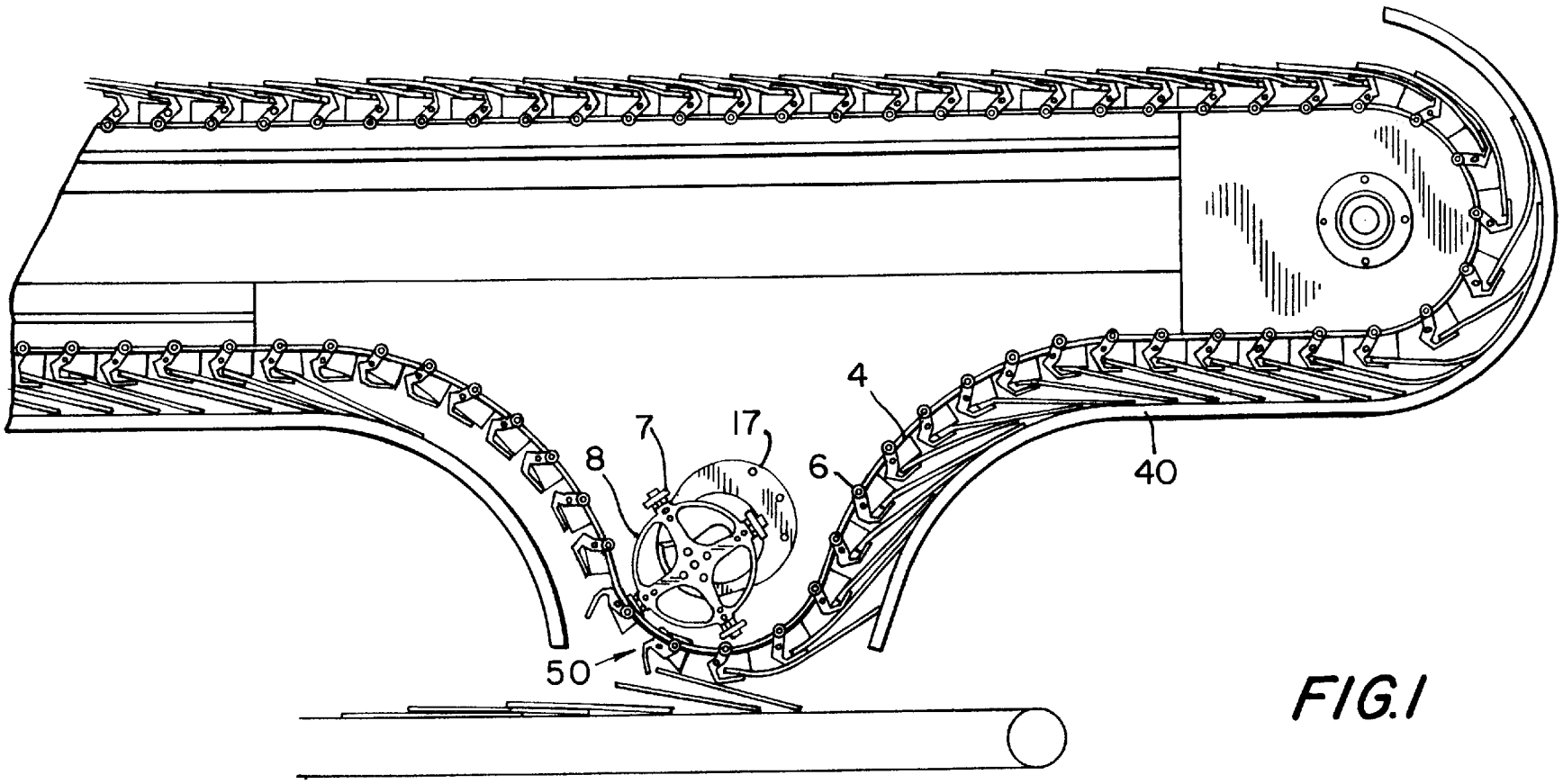
FIG. 1 shows a part of a conveyor having a device according to the invention.

Referring now to FIGS. 1–4, the conveyor comprises an endless band or chain 4 which carries a number of clamps 50 which are arranged at equal distance from each other and each having relative to the band 4 a fixed part 2 and a movable part 1. The movable part can turn relative to the fixed part around a shaft 3 and also comprises an arm 5 which extends out from the movable part on the other side of the shaft 3. The arm 5 carries a wheel 6. The movable part 1 of the clamp 50 is spring-loaded by a spring 30 so that, if it is not affected by other forces, it rests onto the fixed part 2. The clamp 50 can be opened thereby that the wheel 6 on the arm 5 is actuated. The object which is transported is during the transportation clamped between the clamping surfaces 31 and 32 of the fixed and movable part, respectively, of the clamp 50. The clamp 50 is connected to the conveyor 4 by wheel 33 and is linked to a number of identical clamps 50 connected to or disposed on the conveyor 4.

Figure 3:
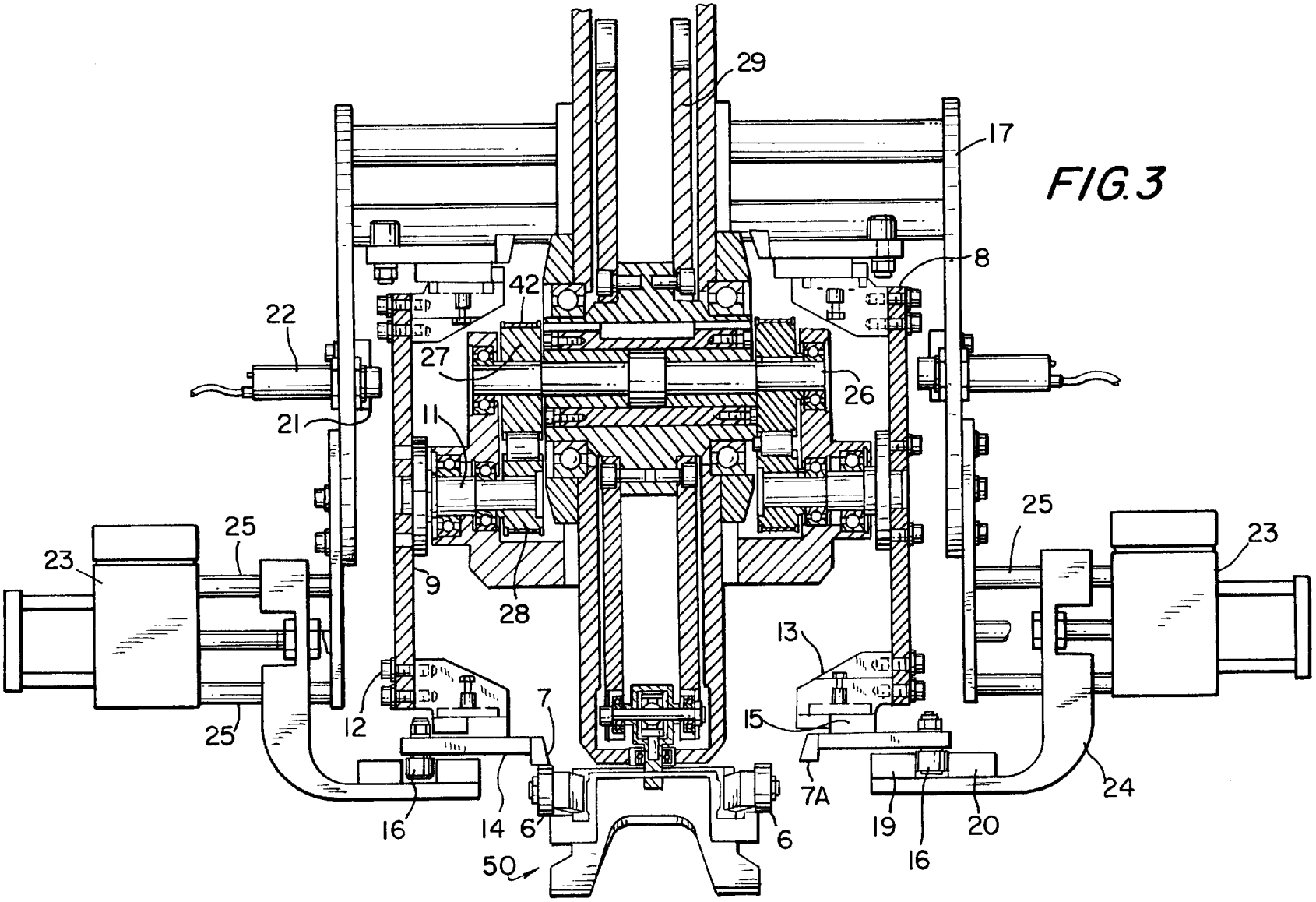
FIG. 3 shows a cross-section of the device of FIG. 2.
Figure 4:
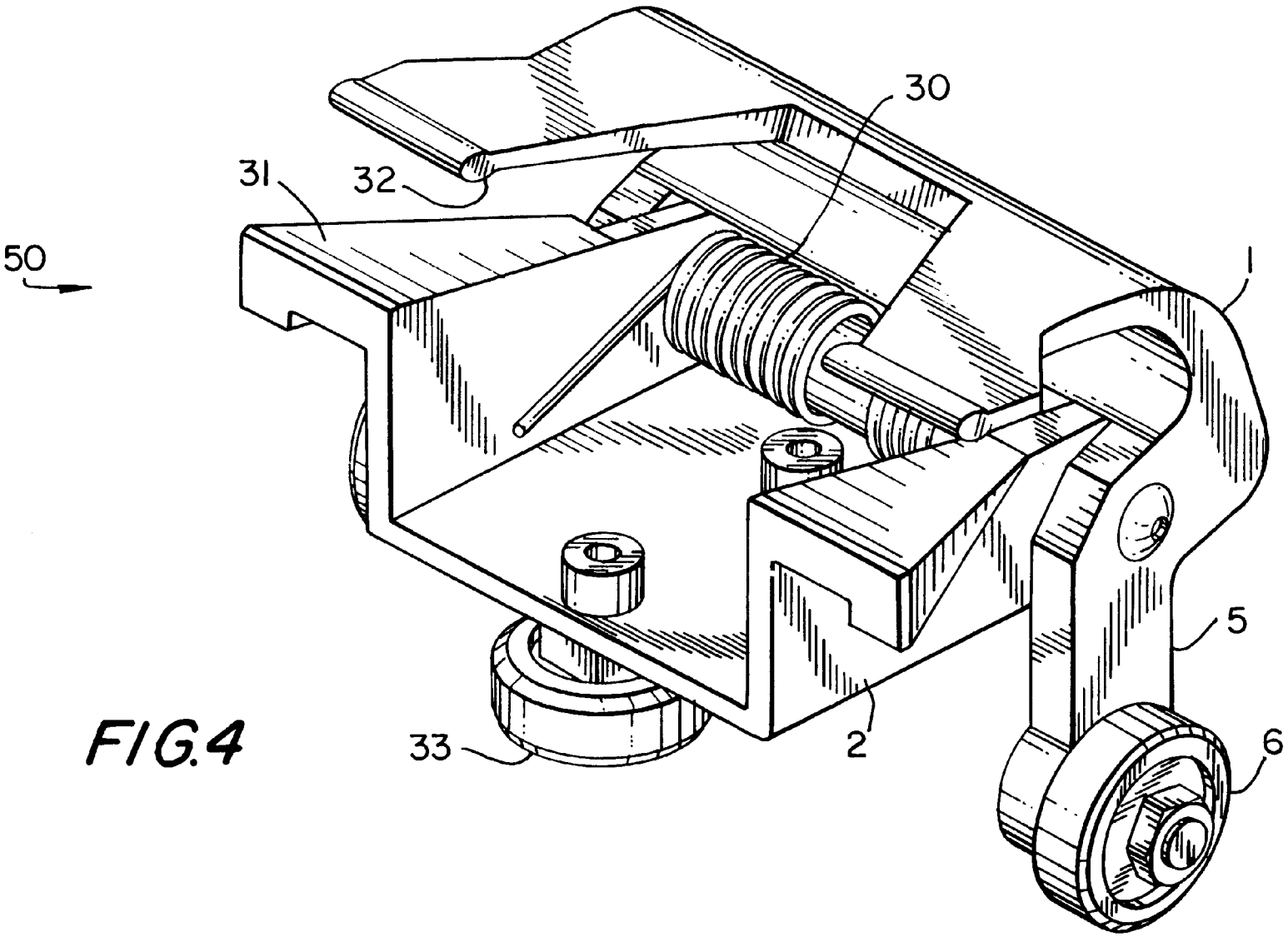
FIG. 4 shows a clamp of the conveyor.

As shown in FIG. 3, the device for actuating the clamps 50 is double-sided and the two sides are of identical design and that the two sides are offset rotationally by above 45 degrees. Each side of the device can actuate every second clamp 50 of the conveyor. The following description, therefore, refers to one side only. The device comprises several cams 7, 7A which are intended to influence the wheel 6 of the clamp 50 which is to be opened. Each cam 7, 7A is part of a cam holder 14, which is movably or slidably attached to a holder 13 which in turn is mounted on a wheel 8. The holder 14 with the cam 7 can be moved to the right or the left as the device is shown in FIG. 3. On the holder 14 there is also a wheel 16 intended to be actuated when the cam 7 shall be moved. The wheel 8 is adjustably attached to the shaft 11 by means of screws 12. By pulleys 27, 28 and a cog band 42 this shaft 11 is in turn connected to a shaft 26 which is common for the two symmetric parts. The shaft 26 is driven by a sprocket 29 which rotates synchronously with the conveyor 4.

Still referring to FIG. 3, the device also includes a mounting plate 17, onto which a hydraulic or pneumatic cylinder 23 is mounted and which is mounted onto the mounting plate by guide bars 25. Slidably by operation of the cylinder 23 is mounted on the guide bars 25 a holder 24 onto which there are two guide rails 19, 20. These guide rails are arranged to actuate the wheel 16 and thereby move the respective cam 7 between a right and a left position according to the FIG. 3. The rotation of the wheel 8 is by synchronisation with the conveyor chain 4 such that every second clamp 50 of the conveyor can be actuated by the cam on the wheel on one side of the conveyor and the clamps 50 situated in between can be actuated by a cam on the other wheel which is rotationally offset by about 45° from the wheel. The wheels 8 are designed as spoke wheels having one spoke 9 for each cam. The position of the wheel 8 is sensed by a sensor 22 which by means of a holder 21 is mounted onto the mounting plate 17.

Along the conveyor there may be several delivery stations of the kind described above. Their function can be controlled by a programmable system for delivery of a desired number of copies at each station. The system preferably includes devices for delivery of single copies as desired.

Figure 2:
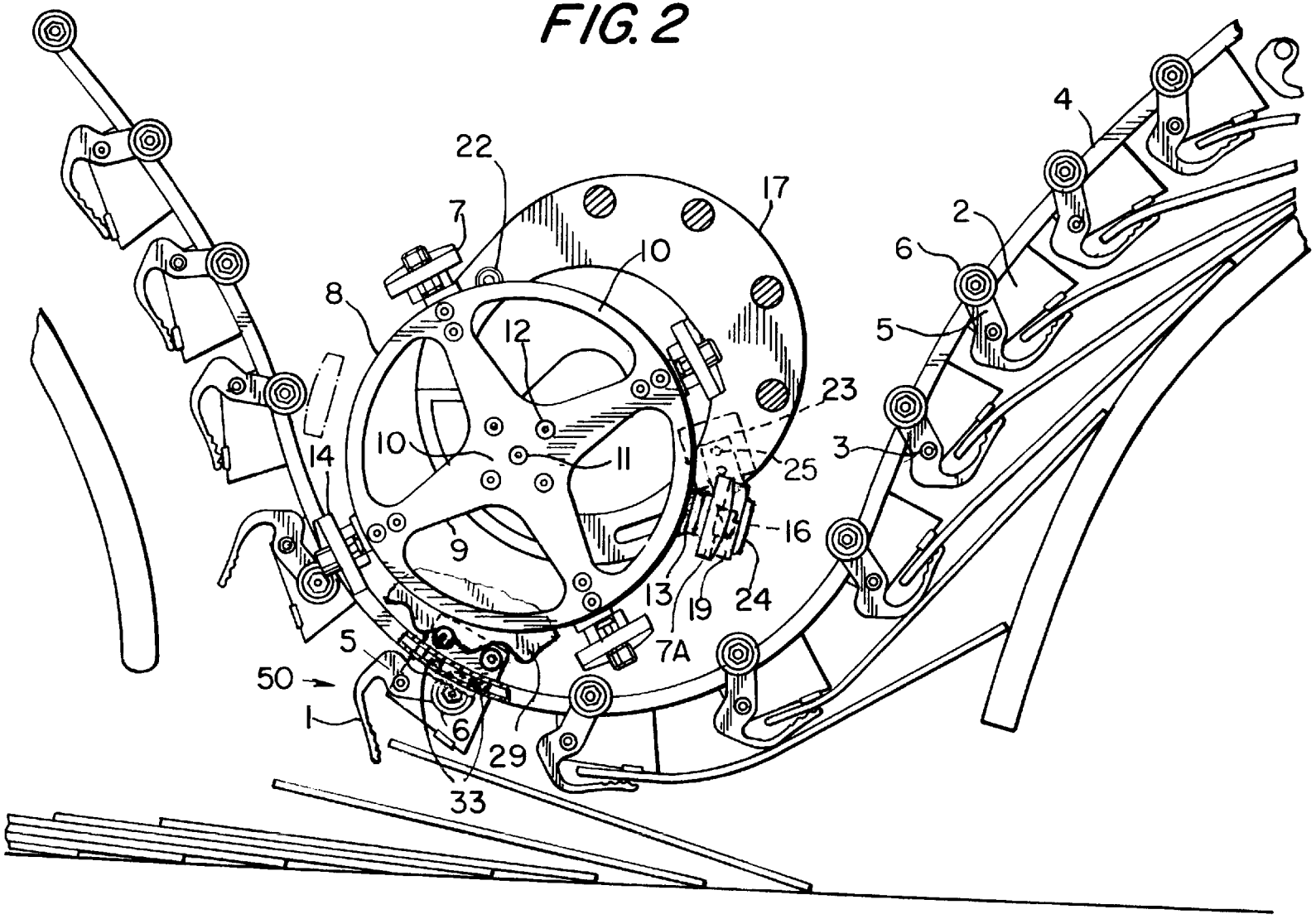
FIG. 2 shows the device according to the invention as seen from the side.

As depicted in FIGS. 1 and 2, the cams mounted onto a wheel 8 move along a circular path. Preferably the conveyor is also circular within the area where the cams shall actuate the, clamps. The circle of the conveyor may have a different diameter and a different centre point than the wheel which carries the cams. FIGS. 1 and 2 show an embodiment where the conveyed objects are released from the conveyor as the clamps move upward. In this way the time that the clamp needs to be open is a little shorter than if the open position should be equally distributed on both sides of a vertical line.

At the conveyance the conveyed objects, e.g. newpapers, may be supported by a fixed surface 40 which ends at those positions where delivery of objects shall be possible. The supporting surface is, of course, needed only for those parts of the conveyor where the objects would otherwise be conveyed hanging freely.

Provided that sufficient time of contact is available it is also possible that the conveyor is straight when it passes the cams. One advantage of such a device may be that it is less space consuming as the deviation from the straight conveyor lane is unnecessary. Also from design, production and assembly points of view the straight embodiment may have both technical and cost advantages. Also other embodiments are within the scope of the invention. The wheel described above as a spoked wheel may have a different design provided that the wheel a device which can affect the sensor of the system.

I claim:

1. A handling device for a conveyor of printed articles and having a clamp mounted to the conveyor for releasably retaining one of the printed articles, the clamp having a fixed part and a movable part pivotably attached to the fixed part, the movable part comprising an arm pivotably movable between a closed position of the clamp in which the arm is pivoted toward the fixed part so as to releasably retain the one of the printed articles in the clamp and an open position of the clamp in which the arm is pivoted away from the fixed part so as to release the retained one of the printed articles from the clamp, said handling device comprising:

a rotatable wheel having an axis and mounted proximate the conveyor for operative rotation about the axis;

a cam holder having a distal end and a proximal end and including a cam at said distal end, said cam having a shape configured to engage a portion of the arm for moving the arm between said open and closed positions of the clamp;

a first holder attached to said rotatable wheel, said cam holder being slidably mounted on said first holder so that said cam holder is slidably movable in a direction which is substantially parallel to the axis of said rotatable wheel to effect engagement of said cam and said arm portion; and a non-rotatable actuating device disposed proximate said wheel and including a second holder for selectively moving said cam holder in the axial direction, said second holder having a guide configured to selectively engage and guide said proximal end of the cam holder for travel along an arcuate conveying path as said wheel is operatively rotated to provide continued engagement of said cam and said clamp over at least a portion of said arcuate path.

2. The device according to claim 1, further comprising at least one sensor for sensing a rotative position of the wheel.

3. The device according to claim 1, wherein the wheel comprises a spoked wheel having a plurality of spokes and said first holder being attached to said wheel proximate one of said spokes, further comprising a sensor for sensing said spokes to sense a rotative position of the wheel.

4. The device of claim 1, wherein said non-rotatable actuating device comprises a pneumatic cylinder.

5. The device of claim 1, wherein said non-rotatable actuating device comprising a hydraulic cylinder.

6. The device of claim 1, wherein the proximal end of the cam holder includes a roller.

7. The device of claim 6, wherein said guide of said second holder comprises two guide rails spaced apart to define a groove for receiving and guiding said roller of the cam holder.

8. The device of claim 1, further comprising a spring for normally biasing the clamp to said closed position.

* * * * *